US009273923B2

(12) United States Patent
McPherson et al.

(10) Patent No.: US 9,273,923 B2
(45) **Date of Patent: *Mar. 1, 2016**

(54) ARCHERY BOW LIMB SUPPORT

(71) Applicant: MCP IP, LLC, Sparta, WI (US)

(72) Inventors: Mathew A. McPherson, Norwalk, WI (US); Gary L. Simonds, Gainesville, FL (US)

(73) Assignee: MCP IP, LLC, Sparta, WI (US)

( * ) Notice: Subject to any disclaimer, the term of this patent is extended or adjusted under 35 U.S.C. 154(b) by 207 days.

This patent is subject to a terminal disclaimer.

(21) Appl. No.: 13/903,619

(22) Filed: May 28, 2013

(65) Prior Publication Data

US 2013/0255653 A1 Oct. 3, 2013

Related U.S. Application Data

(63) Continuation of application No. 12/893,979, filed on Sep. 29, 2010, now Pat. No. 8,448,630.

(60) Provisional application No. 61/246,901, filed on Sep. 29, 2009.

(51) Int. Cl.

| | |
|---|---|
| ***F41B 5/00*** | (2006.01) |
| ***F41B 5/14*** | (2006.01) |
| ***F41B 5/12*** | (2006.01) |
| ***F41B 5/10*** | (2006.01) |

(52) U.S. Cl.

CPC ..... *F41B 5/1403* (2013.01); *F41B 5/00* (2013.01); *F41B 5/10* (2013.01); *F41B 5/123* (2013.01)

(58) Field of Classification Search

CPC ..... F41B 5/00; F41B 5/10; F41B 5/123; F41B 5/0052; F41B 5/0094; F41B 5/1403

See application file for complete search history.

(56) References Cited

U.S. PATENT DOCUMENTS

| | | | | |
|---|---|---|---|---|
| 3,000,628 | A | 9/1961 | Kellogg | |
| 3,161,189 | A | 12/1964 | Chessman | |
| 3,262,442 | A | 7/1966 | Grable | |
| 3,481,295 | A | 12/1969 | Campbell et al. | |
| 3,486,495 | A | 12/1969 | Allen | |
| 3,566,853 | A | 3/1971 | Larm | |
| 3,814,075 | A | 6/1974 | Hoyt, Jr. | |
| 3,923,036 | A | 12/1975 | Jennings et al. | |
| 3,942,506 | A | 3/1976 | Izuta | |
| 4,061,124 | A | 12/1977 | Groner | |
| 4,091,790 | A | 5/1978 | Hoyt, Jr. | |
| 4,183,345 | A | 1/1980 | Caldwell | |
| 4,350,138 | A | 9/1982 | Caldwell | |
| 4,574,766 | A | 3/1986 | Izuta | |
| 4,674,468 | A | 6/1987 | Izuta | |
| 4,735,667 | A | 4/1988 | Johnston | |
| 5,172,679 | A | 12/1992 | Mussack | |
| 5,174,268 | A * | 12/1992 | Martin et al. | 124/25.6 |
| 5,231,970 | A | 8/1993 | Ploot et al. | |
| 5,243,957 | A | 9/1993 | Neilson | |
| 5,280,779 | A | 1/1994 | Smith | |
| 5,339,790 | A | 8/1994 | Smith | |
| 5,427,085 | A | 6/1995 | Martin | |
| 5,429,106 | A | 7/1995 | Martin et al. | |

(Continued)

*Primary Examiner* — John E Simms, Jr.

(57) ABSTRACT

In some embodiments, an archery bow is configurable between a first draw orientation and a second draw orientation. The bow comprises a limb and a limb support. The limb defines an unsupported length in either orientation, wherein the unsupported length of the limb is less in the second draw orientation than in the first draw orientation.

20 Claims, 6 Drawing Sheets

(56) References Cited

U.S. PATENT DOCUMENTS

| | | | | |
|---|---|---|---|---|
| 5,433,792 | A | 7/1995 | Darlington | |
| 5,464,001 | A | 11/1995 | Peck | |
| 5,487,373 | A | 1/1996 | Smith | |
| 5,507,270 | A | 4/1996 | Smith | |
| 5,515,836 | A | 5/1996 | Martin et al. | |
| 5,546,923 | A | 8/1996 | Duncan | |
| 5,660,158 | A | 8/1997 | Rudolph | |
| 5,720,267 | A | 2/1998 | Walk | |
| 5,722,380 | A | 3/1998 | Land et al. | |
| 5,931,146 | A | 8/1999 | Schrader et al. | |
| 6,024,076 | A | 2/2000 | Laborde et al. | |
| 6,244,259 | B1 | 6/2001 | Adkins | |
| 6,360,734 | B1 | 3/2002 | Andrews | |
| 6,470,870 | B1 | 10/2002 | Schaar | |
| 6,543,432 | B2 | 4/2003 | Andrews et al. | |
| 6,571,785 | B1 | 6/2003 | Choma | |
| 6,886,549 | B2 | 5/2005 | McPherson | |
| 6,941,937 | B2 | 9/2005 | Wheeler | |
| 7,025,051 | B1 | 4/2006 | Gallops, Jr. | |
| 7,077,116 | B1 | 7/2006 | Darlington | |
| 7,308,890 | B1 | 12/2007 | Wheeler | |
| 7,334,575 | B2 | 2/2008 | McPherson | |
| 7,584,750 | B2 | 9/2009 | Chang | |
| 8,069,847 | B2 | 12/2011 | Blosser | |
| 2003/0084893 | A1 | 5/2003 | Andrews | |
| 2005/0121012 | A1 | 6/2005 | McPherson | |
| 2006/0011181 | A1 | 1/2006 | Andrews | |
| 2008/0072888 | A1 | 3/2008 | Chang | |
| 2008/0127961 | A1* | 6/2008 | McPherson | 124/88 |
| 2008/0156310 | A1 | 7/2008 | Leven | |
| 2008/0236557 | A1 | 10/2008 | Budd | |
| 2009/0071457 | A1 | 3/2009 | Gordon et al. | |
| 2009/0071458 | A1 | 3/2009 | Gordon et al. | |
| 2009/0145411 | A1 | 6/2009 | Sims et al. | |
| 2010/0263650 | A1* | 10/2010 | Dahl et al. | 124/25.6 |

* cited by examiner

ARCHERY BOW LIMB SUPPORT

CROSS-REFERENCE TO RELATED APPLICATIONS

This application is a continuation of U.S. patent application Ser. No. 12/893,979, filed Sep. 29, 2010, now U.S. Pat. No. 8,448,630, which claims the benefit of U.S. Provisional Patent Application No. 61/246,901, the entire disclosures of which are hereby incorporated herein by reference.

BACKGROUND OF THE INVENTION

This invention relates generally to archery bows and more specifically to a support for an archery bow limb and/or an archery bow incorporating said support.

Archery bows typically include one or more limbs. As the bow is drawn, the limb(s) flex and store energy. The energy is then transferred to an arrow upon firing.

Archery bow limbs are often considered cantilever members or simply supported beams, which are supported at one end by a riser. For example, a limb can be bolted to a riser, which provides a moment support to the limb. Often a main limb bolt and a bearing surface of the riser provide support, wherein the main limb bolt provides a force to the tension side of the limb and the bearing surface provides a force to the compression side of the limb. In some bows, a compressive bearing member is positioned between the riser bearing surface and the limb.

The compressive bearing support location typically comprises a fulcrum. As the bow is drawn, the limb flexes around the fulcrum and stores energy. Portions of the limb that extend past the fulcrum are generally unsupported by the riser. The maximum bending moment present in a flexed limb is generally located at the fulcrum, and failures in limbs often occur at or around the fulcrum.

There remains a need for novel archery bow designs and novel methods for supporting archery bow limbs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow is configurable between a first draw orientation and a second draw orientation. The bow comprises a limb and a limb support. The limb defines an unsupported length in either orientation, wherein the unsupported length of the limb is less in the second draw orientation than in the first draw orientation. In some embodiments, the unsupported length of said limb in the second draw orientation is less than 95% of the unsupported length of said limb in the first draw orientation.

In some embodiments, a limb support comprises a plurality of distinct support members/portions, thus providing a discontinuous supporting surface.

In some embodiments, an archery bow comprises a limb and a limb support member that includes a first support portion and a second support portion. The bow is configurable between a first orientation and a second orientation. The limb does not contact the second support portion in the first orientation, but does contact the second support portion in the second orientation. In some embodiments, the first support portion contacts the limb in the first orientation and in the second orientation.

In some embodiments, the first support portion comprises a fulcrum for the limb in the first orientation. In some embodiments, the second support portion comprises a fulcrum for the limb in the second orientation.

In some embodiments, a distance between the first support portion and the second support portion is at least 5% of a length of the limb.

In some embodiments, the supporting surface is continuous between the first support portion and the second support portion. In some embodiments, the supporting surface comprises an arcuate or parabolic shape. In some embodiments, the shape of the supporting surface can be adjusted to account for a changing shape in the limb.

In some embodiments, the limb support member comprises a third support portion that does not contact the limb in the first orientation or in the second orientation. The bow is configurable to a third draw orientation wherein the limb contacts the third support portion.

In some embodiments, the limb comprises a compression surface and a side surface, and the limb support is arranged to contact the side surface in the second orientation. In some embodiments, the side surface is angled, for example being oriented non-orthogonally to the compression surface. In some embodiments, the limb comprises a non-rectangular cross-sectional shape.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
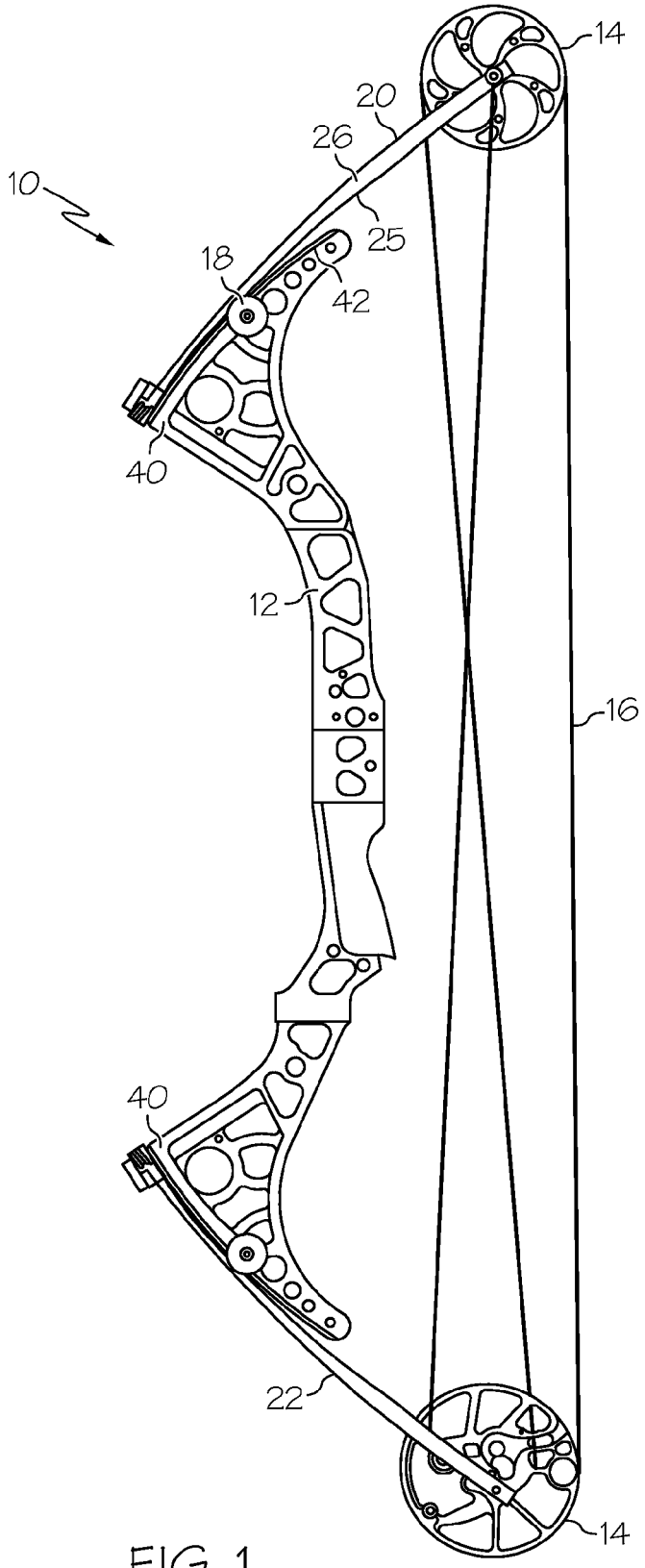
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 in a first orientation, such as an orientation at brace condition. The bow 10 comprises a limb 20 and a limb support 40. In the brace condition, the limb support 40 comprises a portion 42 that is spaced apart from the limb 20.

Figure 2:
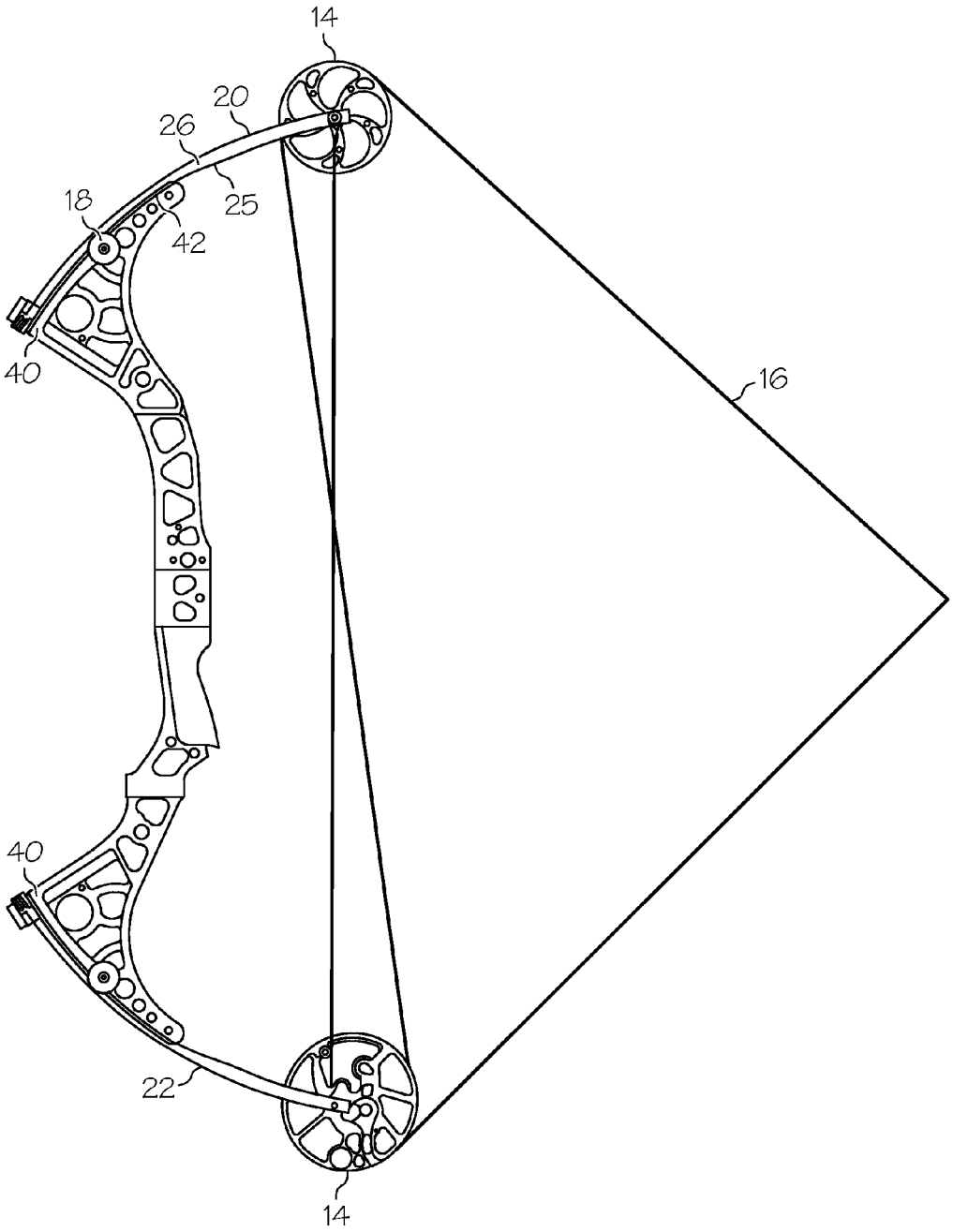
FIG. 2 shows the bow of FIG. 1 in a different condition of draw.

FIG. 2 shows the bow 10 of FIG. 1 in another orientation, such as a drawn condition. The limb 20 has been flexed about a contacting surface of the limb support 40 such that the portion 42 previously spaced apart from the limb 20 now contacts the limb 20. Thus, the bow 10 provides for deflected limb support and the effective fulcrum location, about which the limb 20 bends, moves as the bow 10 is drawn. An unsupported length of the limb 20 in the drawn condition is less than an unsupported length of the limb 20 at brace.

FIGS. 1 and 2 illustrate a single-cam compound bow design; however, the concept of a bow having deflected limb support can be used in any suitable type of bow, such as single limb bows, multiple limb bows, non-compounding bows, compounding bows including dual cam and hybrid or 1.5 cam bows, single-cam bows, crossbows, etc.

The bow 10 shown in FIGS. 1 and 2 comprises a riser 12, a first limb 20 and a second limb 22. The limbs 20, 22 are supported by the riser 12, which comprises a limb support 40 portion for each limb 20, 22. Each limb 20, 22 can be considered a cantilever member that supports a rotatable member 14, such as a cam or pulley. Each limb 20, 22 is supported by a moment connection with the riser 12. Cables extending between the rotatable members 14 are held in tension. As the bowstring cable 16 is drawn, the limbs 20, 22 flex and store energy.

In some embodiments, the limb support 40 is distinct from the riser 12. For example, in some embodiments, a limb cup (not illustrated) or other secondary structure comprises the limb support 40. A secondary structure can be attached to the riser 12, and the limb 20 can be attached to the secondary structure. An example of a prior art limb cup is disclosed in U.S. Pat. No. 7,334,575, the entire contents of which are hereby incorporated herein by reference.

In some embodiments, a bow 10 comprises one or more lateral support members 18 positioned to brace a limb 20 against lateral displacement. For example, a lateral support member 18 can be positioned to contact a sidewall 26 of a limb 20. A lateral support member 18 can be attached to any suitable portion of the bow 10, such as the riser 12, a limb cup or a limb support 40. In some embodiments, a lateral support member 18 is provided only for lateral support of the limb 20, and does not provide any supporting reaction force to a compression side 25 of the limb 20.

Figure 5:
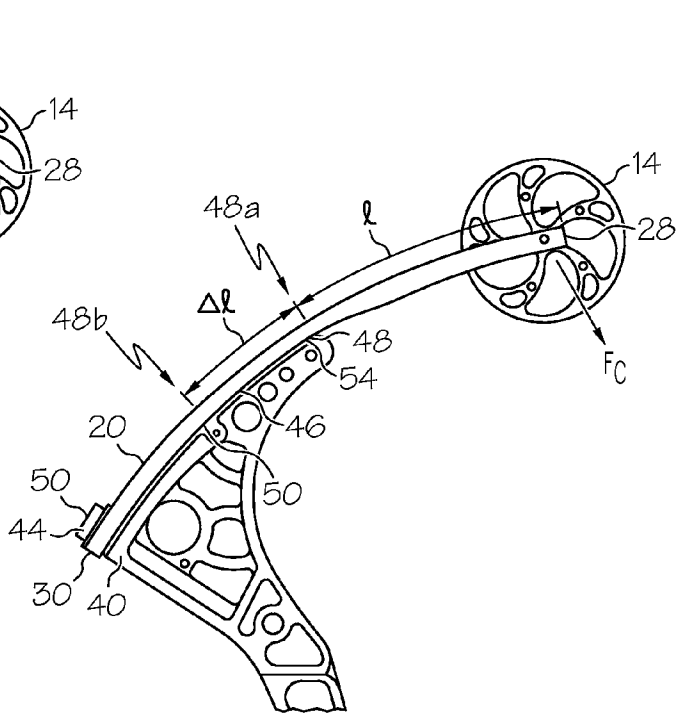
FIG. 5 shows the embodiment of FIG. 3 in an orientation different from that of FIG. 4.
Figure 4:
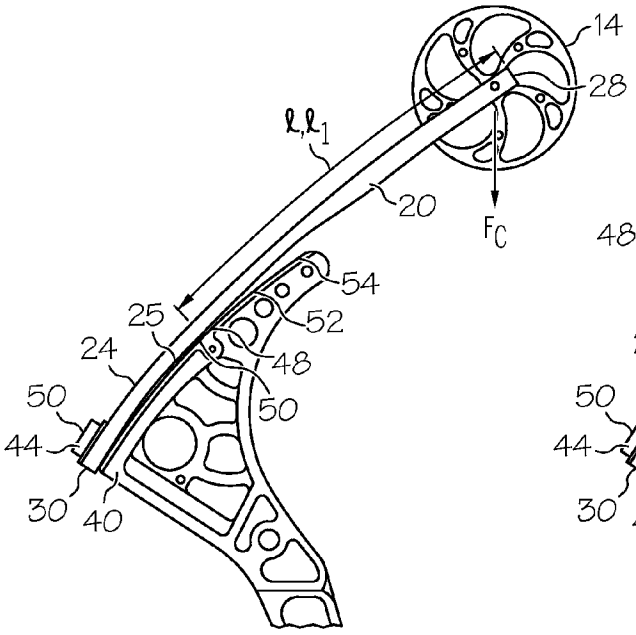
FIG. 4 shows the embodiment of FIG. 3 in a first orientation.
Figure 3:
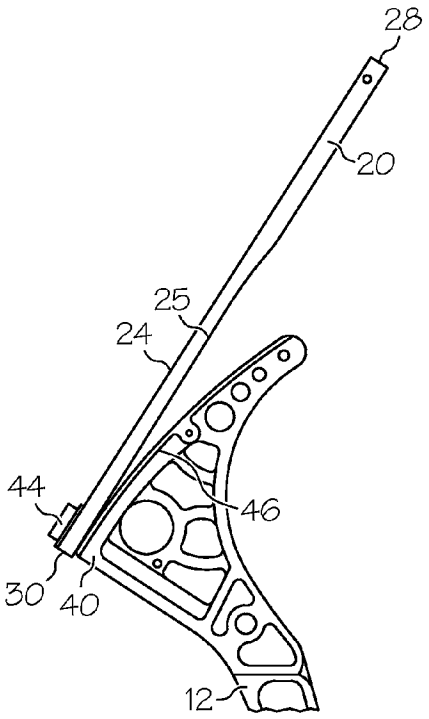
FIG. 3 shows an embodiment of a limb and limb support.

FIGS. 3-5 show an embodiment of a limb 20 and an embodiment of a limb support 40 at various orientations. FIG. 3 shows the items in a condition before full assembly of a bow, wherein a tip end 28 of the limb 20 is not yet loaded. A butt end 30 of the limb 20 is attached to the limb support 40 using a fastener 44, such as a limb bolt or cap screw. For the terminology of this application, the butt end 30 can also be considered a proximal end 30 (e.g. situated closer to the supported end of the limb 20) and the tip end 28 can also be considered a distal end 28 (e.g. situated farther away from the supported end of the limb 20).

In some embodiments, a limb support 40 comprises a supporting surface 46 that slopes or curves away from the limb 20. A supporting surface 46 can have any suitable span and shape. In some embodiments, a supporting surface 46 is continuous and spans a substantial portion of the length of the limb 20. In various embodiments, a length of the supporting surface 46 can be any of less than 5%, 5%, 10%, 20%, 30%, 40%, 50%, 60%, 70%, 80%, 90%, 95% or more than 95% of the length of the limb 20, or any suitable amount between the various numbers listed.

The specific configuration of the supporting surface 46 can be selected in a way that limits the stresses present in various parts of the limb 20 as the bow is drawn. In some embodiments, the supporting surface 46 can have an arcuate shape. In some embodiments, the supporting surface 46 can have a parabolic shape. In some embodiments, the slope of the supporting surface 46 increases continuously as the supporting surface 46 is traversed.

FIG. 4 depicts a limb 20 and a limb support 40 in a first orientation, for example at brace condition. A force $F_c$ is applied to the distal end 28 of the limb 20, for example by a rotatable member 14 that transmits forces applied to the rotatable member 14 by various cables (not shown). The limb 20 has been flexed such that at least a portion of the limb 20 located distal to the fastener 44 is in contact with the limb support 40. The limb support 40 comprises a first support portion 50 that contacts the limb 20 in the first orientation.

The first support portion 50 can be considered to provide the supporting moment force to the limb 20 in the brace condition. Often the moment support in an archery bow comprises a force couple provided by the fastener 44 (e.g. limb bolt) and a compression member that contacts the compression side 25 of the limb 10, such as a limb pad. Thus, the first support portion 50 is directed to a location that provides a force reaction to the compression side 25 of the limb in the brace condition.

The limb support 40 also comprises a second support portion 52 and a third support portion 54, which do not contact the limb 20 in the first orientation. A gap exists between the second support portion 52 and the limb 20, and between the third support portion 54 and the limb 20, in the brace condition. In some embodiments, the gap between the third support portion 54 and the limb 20 is larger than the gap between the second support portion 52 and the limb 20 in the brace condition.

In the orientation shown in FIG. 4, the distalmost portion of the limb support 40 that contacts the limb 20 defines a fulcrum 48. In some embodiments, the portion of the first support portion 50 that applies force to the compression side 25 of the limb 20 comprises the fulcrum 48 in the brace condition.

In some embodiments, the limb 20 contacts the limb support 40 continuously from the fastener 44 to the fulcrum 48. In some embodiments, the limb support 40 provides a distributed load to the limb 20, wherein the distributed load spans a length portion of the limb 20 (e.g. from the fulcrum 48 to another portion of the limb 20 located proximal to the fulcrum 48, such as a location near the fastener 44).

The limb 20 has an unsupported length l in any given orientation. As the orientation of the bow changes to a drawn condition, the unsupported length l desirably changes. The unsupported length l can be defined as the length of the limb 20 located distal to the fulcrum 48. The unsupported length l can be measured to the distal end 28 of the limb 20, or alternatively to the effective location of the force $F_c$ applied to the limb 20 near the distal end 28. The specific way of measuring the unsupported length l should be consistent when the various bow orientations are being compared.

As the bow is drawn from the condition of FIG. 4 (e.g. brace condition) to a drawn condition, the limb 20 deflects and the fulcrum 48 moves in the direction of the distal end 28 of the limb 20 as a greater amount of the limb contacts the supporting surface 46. As the bow is drawn, it will reach a second orientation (e.g. mid-draw) wherein the second support portion 52 contacts the limb 20 but the third support portion 54 does not. The unsupported length l of the limb 20 in the second orientation is less than in the first orientation.

FIG. 5 shows the limb 20 and limb support 40 in a third orientation, such as at full draw, wherein the third support portion 54 contacts the limb 20. The fulcrum 48 has moved to an end of the supporting surface 46 of the limb support 40. The unsupported length l of the limb 20 in the third orientation is less than in the second orientation. In some embodiments, the limb 20 contacts the limb support 40 continuously from the first support portion 50 to the fulcrum 48 in the third orientation. In some embodiments, the limb 20 contacts the limb support 40 continuously from the fastener 44 to the fulcrum 48 in the third orientation.

As the bow is drawn between two different orientations, a change in the unsupported length Δl comprises a distance that the fulcrum 48 moves between the two orientations. For example, FIG. 5 illustrates a change in the unsupported length Δl as the distance between the fulcrum at brace $\mathbf{48}_b$ (e.g. the fulcrum 48 location in FIG. 4) and the fulcrum at full draw $\mathbf{48}_d$. The change in the unsupported length Δl between first and second draw orientations can be compared to the unsupported length l of the limb 20 in the first draw orientation $l_1$. In various embodiments, the change in the unsupported length Δl can be any suitable fraction of $l_1$. For example, Δl can range from less than 1% of Δl to greater than 99% of $l_1$. In some embodiments, Δl can range from less than 20% of $l_1$ to greater than 50% of $l_1$. In the embodiment illustrated in FIGS. 4 and 5, a change in the unsupported length Δl between brace and full draw orientations is approximately 35% of the unsupported length of the limb at brace $l_1$. In various embodiments, changes in the unsupported length Δl between brace and full draw orientations are contemplated to be any suitable percentage, such as 10%, 15%, 20%, 25%, 30%, 35%, 40%, 45%, 50%, 55%, 60%, 65%, 70%, 75%, 80%, 85%, 90% of the unsupported length of the limb at brace $l_1$, or any suitable percentage within the listed ranges.

Although FIGS. 3-5 are discussed as having first, second and third support portions 50, 52, 54, the illustrated limb support 40 slopes continuously and gradually away from the limb 20 at locations distal to the fulcrum 48 in the first orientation (e.g. brace condition as shown in FIG. 4). Thus, as the bow is gradually drawn, the limb 20 progressively contacts a greater amount of the limb support 40, and the fulcrum 48 transitions progressively from its location at brace to its location at full draw.

The specific shape of the supporting surface 46 of the limb support 40 can be selected to control the amount of stress in various locations of the limb 20, and to limit deflection of the limb 20. As the fulcrum 48 moves toward the distal end 28 of the limb 20, the stresses in the limb 20 in locations proximal to the fulcrum 48 are limited, and the supporting forces provided by the limb support 40 are distributed over the area of the limb 20 in contact with the supporting surface 46.

In some embodiments, the supporting surface 46 can be shaped to match the deflected shape of the supported surface of the limb 20, for example at full draw. In embodiments where a surface of the limb 20 that contacts the supporting surface 46 includes curvature or other shaping in an unstressed condition, the supporting surface 46 can be shaped accordingly to account for the initial shape of the limb 20. For example, a compression side 25 of the limb 20 can have undulations, and the supporting surface 46 can be shaped to account for the undulations and contact the limb 20 continuously across the supported area in a drawn condition.

In some embodiments, a method of determining the deflected shape of the limb 20 comprises using calculations to calculate a theoretical deflected shape of the limb 20, and the supporting surface 46 can be matched to the theoretical deflected shape. For example, a bow can be modeled as if the deflected support were not provided (e.g. as if the portion of the limb support 40 located distal to the fulcrum 48 in the brace condition were omitted) to determine the theoretical deflected shape.

In some embodiments, a method of determining the deflected shape of the limb 20 comprises providing an actual bow and measuring the actual limb 20 deflection.

In some embodiments, the supporting surface 46 can be shaped to brace the limb 20 "above" its theoretical deflected shape had the bracing been omitted. Such a configuration will limit deflection and prevent the limb 20 from reaching its theoretical deflected shape 20, thereby limiting the stresses in the limb 20.

In lowering the unsupported length l of a limb 20 in a drawn condition, the limb support 40 provides support to the limb 20 at locations closer to the applied loads $F_c$ (see FIGS. 4 and 5). This increases the torsional rigidity of the limb 20 as the bow is drawn, and limits twisting of the limbs 20 due to torsion.

In distributing the compressive reaction forces applied to the limb 20 (e.g. across an area proximal to the fulcrum at draw), the limb support 40 can lower the tensile load on the fastener 44.

Figure 6:
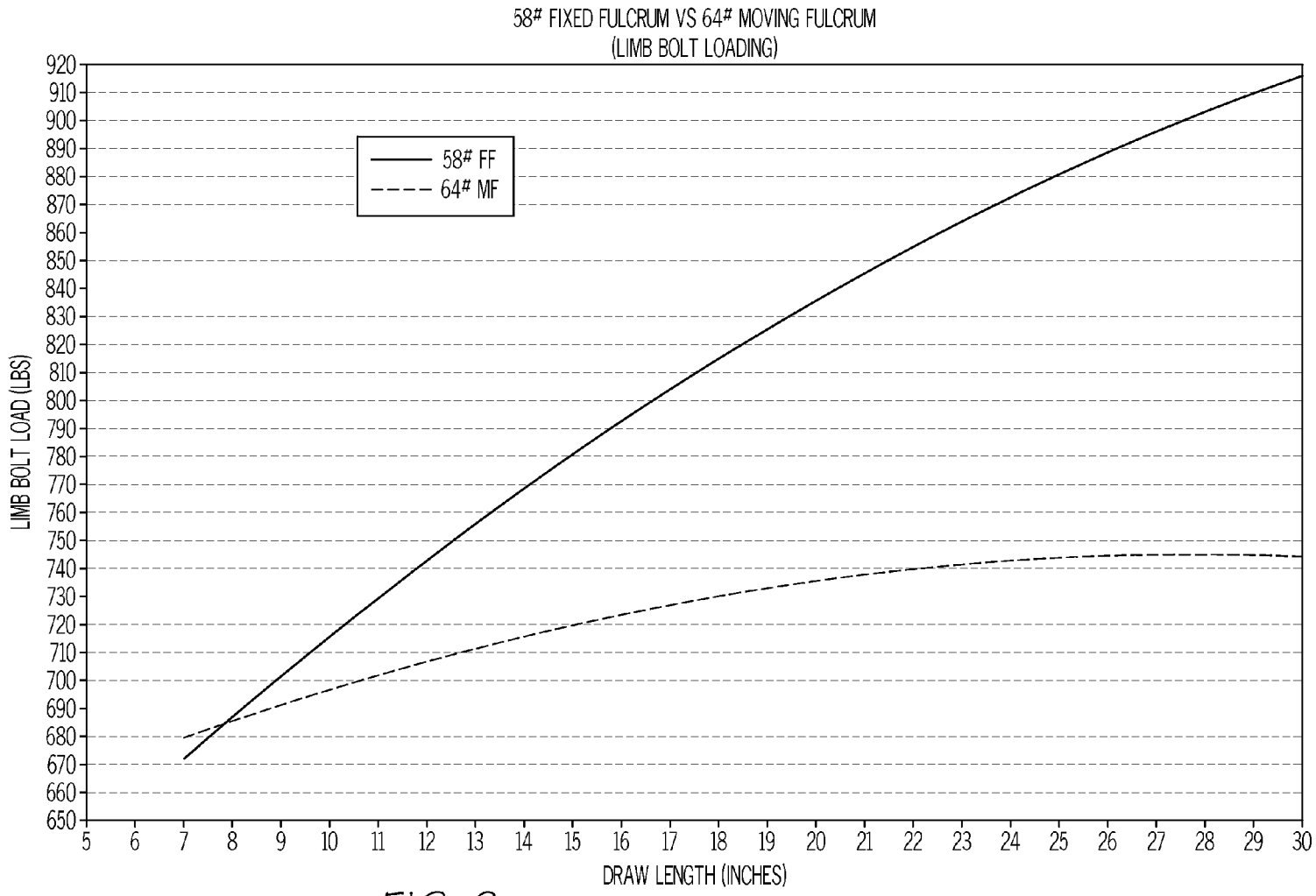
FIG. 6 shows a graph of limb bolt loading for a fixed fulcrum bow and for a moving fulcrum bow.

FIG. 6 shows a graph comparing the loading of a limb bolt fastener in a traditional fixed fulcrum bow to the loading of a similar bolt in a moving fulcrum bow. The fastener loading is approximately equal when a 58# peak draw weight fixed fulcrum bow and a 64# peak draw weight moving fulcrum bow are compared at brace height. Then as the bows are drawn, the tensile load in the fastener of the fixed fulcrum bow increases from 675# to a maximum of 915# at full draw length in a fairly uniform and traditional fashion. In the moving fulcrum bow, the fastener loading increases from 680# at brace to a maximum value of 745# at full draw. Thus, the loading is substantially less in the moving fulcrum bow, even though the moving fulcrum bow had a higher peak draw weight. Further, the loading force tended to let off as full draw was reached in the moving fulcrum bow.

Figure 7:
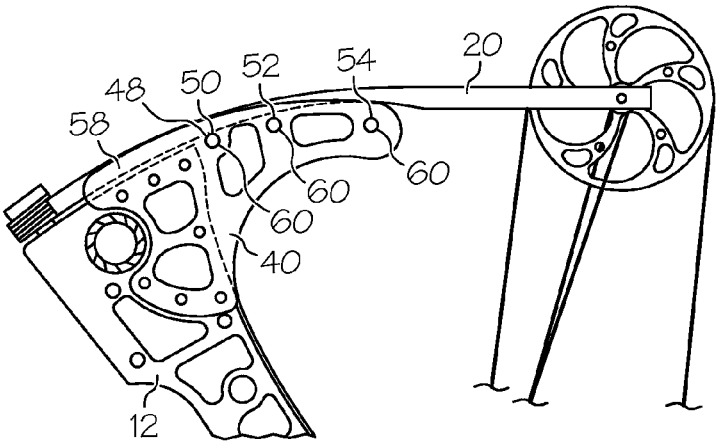
FIG. 7 shows another embodiment of a limb support.
Figure 8:
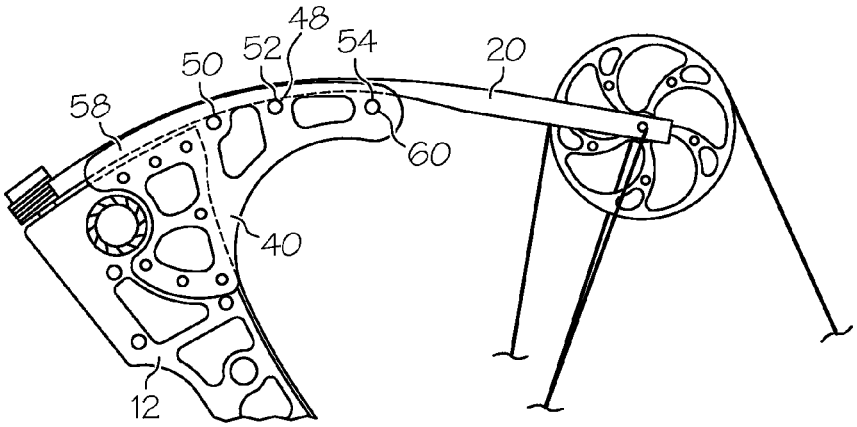
FIG. 8 shows the embodiment of FIG. 7 in an orientation different from that of FIG. 7.
Figure 9:
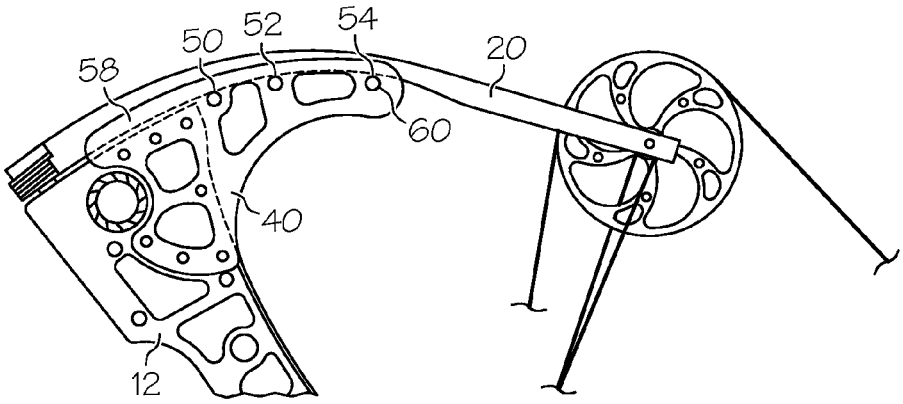
FIG. 9 shows the embodiment of FIG. 7 in an orientation different from that of FIG. 8.

FIGS. 7-9 show another embodiment of a limb support 40 configured to brace a limb 20 in a deflected condition. In some embodiments, a limb support 40 attaches to the riser 12. In some embodiments, a limb support 40 comprises a plurality of distinct support members 60. Each support member 60 is arranged to contact the limb 20 at a given draw orientation. As such, a limb support 40 can define a plurality of supporting surfaces, and the limb support 40 can be discontinuous between the supporting surfaces. In some embodiments, a support member 60 extends orthogonal to a longitudinal axis of the limb 20 (e.g. transversely across the width of the limb 20).

In the embodiment of FIGS. 7-9, a fastener 44 attaches to the riser 12 and provides a tensile reaction force. The limb support 40 provides one or more compressive reaction forces, depending upon the specific condition of draw.

FIG. 7 illustrates a first draw orientation, for example at brace. Each support member 60 provides a support portion. In the first draw orientation, a first support portion 50 contacts the limb 20, whereas a second support portion 52 and a third support portion 54 are both spaced apart from the limb 20. The fulcrum 48 is located at the first support portion 50.

FIG. 8 illustrates a second draw orientation, for example at mid-draw. In the second draw orientation, the first support portion 50 contacts the limb 20 and the second support portion 53 contacts the limb 20. The third support portion 54 is spaced apart from the limb 20. The fulcrum 48 is located at the second support portion 52.

FIG. 9 illustrates a third draw orientation, for example at full draw. In the third draw orientation, the first support portion 50, the second support portion 53 and the third support portion 54 all contact the limb 20. The fulcrum 48 is located at the third support portion 54. The compressive reaction forces applied to the limb 20 by the limb support 40 are distributed across the plurality of support members 60.

A limb support 40 can comprise any suitable number of distinct support members 60, each support member 60 providing a support portion. A person of ordinary skill in the art will recognize that as the number of support portions are progressively increased, the limb support 40 will progressively assume a configuration similar to the embodiment of FIGS. 3-5, which theoretically provides an infinite number of distinct support portions as a continuous supporting surface.

In some embodiments, a limb support 40 comprises one or more flange portions 58, which are positioned to abut a sidewall 26 of a limb 20. A flange portion 58 can be considered a lateral support member. A flange portion 58 can brace the limb 20 against lateral movement, and against twisting.

In some embodiments, a limb support 40 comprises multiple pieces that attach to one another and/or to the riser 12.

In some embodiments, one or more cushion members are placed between the limb 20 and the supporting portion(s) of the limb support 40. A cushion member can help distribute forces applied to local areas of the limb 20.

In some embodiments, side plates (not illustrated) can be used to prevent any foreign object, such as brush, leaves or branches, from becoming positioned between the limb support 40 and the limb 20.

Figure 10:
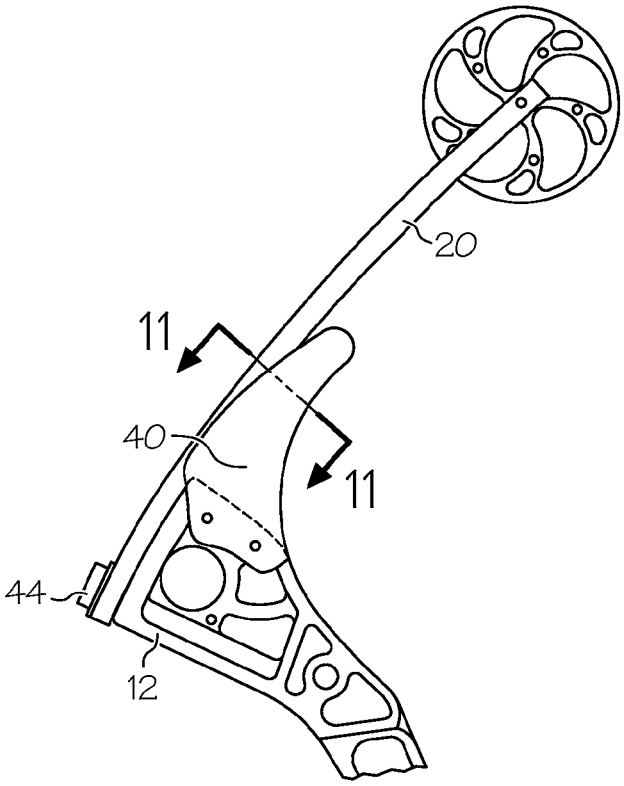
FIG. 10 shows another embodiment of a limb support configuration.

FIG. 10 shows another arrangement for deflected limb support, wherein one or more supports 40 are provided that are arranged to contact a sidewall 26 portion of a limb 20. In some embodiments, the supports 40 do not the lower compression surface 25 of the limb 20.

Figure 11:
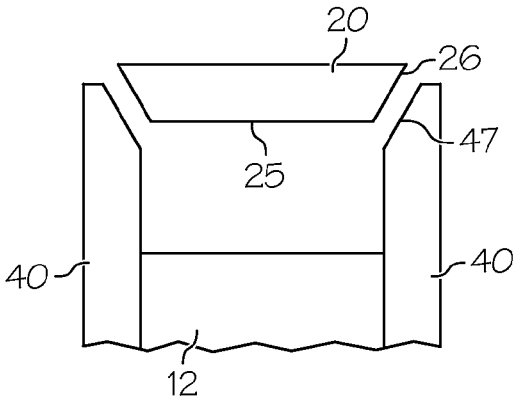
FIG. 11 shows a cross-sectional view taken across line 11-11 in FIG. 10.

To apply reactive forces to a sidewall 26 of the limb 20 without applying forces to the compression side 25, desirably the sidewall 26 is angled, for example comprising a non-rectangular cross-sectional shape, such as a trapezoid as shown in FIG. 11. Desirably, the limb support(s) 40 comprise sidewall supporting surfaces 47, which are angled to match the angle of the limb sidewall 26. When angled sidewall supporting surfaces 47 are used, and the arrangement is mirrored on both sides of the limb 20 as shown in FIG. 12, the supports 40 work to automatically center the limb 20 as it comes into contact with the supports 40.

The angled sidewall supporting surfaces 47 desirably curve away from the limb 20, similar to the configuration of the continuous supporting surface 46 illustrated in FIGS. 3-5. In some embodiments, the sidewall supporting surfaces 47 can be discontinuous, thereby providing support at distinct spaced locations, more similar to the discontinuous support portions 60 disclosed with respect to FIGS. 7-9.

Further, any of the embodiments disclosed herein can incorporate the angled sidewall supporting surfaces 47 contact angled sidewalls 26 of a limb 20. Any feature disclosed herein with respect to any embodiment can be combined with the structure disclosed for any other embodiment.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser comprising a first limb support member and a second limb support member;

a first limb supported by said first limb support member;

a second limb supported by said second limb support member; and a bowstring arranged to flex said first limb and said second limb;

said first limb support member comprising a first support portion and a second support portion;

wherein the bow is configurable between a first draw orientation and a second draw orientation, said limb not contacting said second support portion in the first orientation, said limb contacting said second support portion in the second orientation.

2. The archery bow of claim 1, wherein said first support portion contacts said limb in the first orientation and in the second orientation.

3. The archery bow of claim 1, wherein said first limb support member comprises a fulcrum for said first limb, said fulcrum moving as said bowstring is drawn.

4. The archery bow of claim 3, wherein said fulcrum is located at said first support portion when the bow is in the first draw orientation.

5. The archery bow of claim 4, wherein said fulcrum is located at said second support portion when the bow is in the second draw orientation.

6. The archery bow of claim 1, wherein an unsupported length of the first limb is less in the second draw orientation than in the first draw orientation.

7. The archery bow of claim 1, wherein said limb support member comprises a continuous supporting surface between the first support portion and the second support portion.

8. The archery bow of claim 7, wherein said continuous supporting surface comprises curvature.

9. The archery bow of claim 7, wherein said first limb contacts all of said continuous supporting surface between the first support portion and the second support in the second draw orientation.

10. The archery bow of claim 1, said bow comprising a compound bow having rotatable members.

11. The archery bow of claim 1, wherein said first limb comprises opposed side surfaces, said first limb support member contacting said opposed side surfaces in the second draw orientation.

12. The archery bow of claim 11, wherein said first limb comprises a non-rectangular cross-sectional shape.

13. The archery bow of claim 1, wherein said limb support member comprises a limb cup.

14. An archery bow comprising:

a riser comprising a first limb support member and a second limb support member;

a first limb supported by said first limb support member;

a second limb supported by said second limb support member; and a bowstring arranged to flex said first limb and said second limb;

wherein said first limb support member comprises a fulcrum for said first limb, said fulcrum moving from a first location to a second location as said bowstring is drawn.

15. The archery bow of claim 14, wherein said first limb defines a length, and a distance between said first location and said second location comprises at least 5% of said length.

16. The archery bow of claim 14, wherein an unsupported length of said first limb decreases as said bowstring is drawn.

17. The archery bow of claim 14, wherein said first limb support member comprises a continuous surface between said first location and said second location.

18. The archery bow of claim 17, wherein said continuous surface comprises curvature.

19. The archery bow of claim 14, wherein said bow comprises a compound bow having rotatable members.

20. The archery bow of claim 14, wherein said first limb does not contact said second location when the bow is in a brace condition.

* * * * *